United States Patent [19]

Foley et al.

[11] Patent Number: 4,572,883

[45] Date of Patent: Feb. 25, 1986

[54] ELECTROPHOTOGRAPHIC IMAGING MEMBER WITH CHARGE INJECTION LAYER

[75] Inventors: Geoffrey M. T. Foley, Fairport; Harvey J. Hewitt, Williamson, both of N.Y.

[73] Assignee: Xerox Corporation, Stamford, Conn.

[21] Appl. No.: 619,109

[22] Filed: Jun. 11, 1984

[51] Int. Cl.[4] ..... G03G 5/14

[52] U.S. Cl. ..... 430/58; 430/66; 430/60; 430/63; 430/86

[58] Field of Search ..... 430/57, 58, 66, 60

[56] References Cited

U.S. PATENT DOCUMENTS

| | | | |
|---|---|---|---|
| 3,041,166 | 6/1962 | Bardeen | 96/1 |
| 3,467,548 | 9/1969 | Straughan | 117/217 |
| 3,635,705 | 1/1972 | Ciuffini | 96/1.5 |
| 3,639,120 | 2/1972 | Snelling | 96/1.5 |
| 3,655,377 | 4/1972 | Sechak | 96/1.5 |
| 4,066,455 | 1/1978 | Mey et al. | 96/1.5 R |
| 4,123,269 | 10/1978 | von Hoene et al. | 96/1 PC |
| 4,170,476 | 10/1979 | Sadamatsu | 96/1.5 N |
| 4,226,929 | 10/1980 | Teshima et al. | 430/57 |
| 4,286,033 | 8/1981 | Neyhart et al. | 430/58 |
| 4,297,424 | 10/1981 | Hewitt | 430/57 |
| 4,338,387 | 7/1982 | Hewitt | 430/58 |
| 4,426,435 | 1/1984 | Oka | 430/132 |
| 4,439,509 | 3/1984 | Schank | 430/132 |

FOREIGN PATENT DOCUMENTS

| | | |
|---|---|---|
| 56-142537 | 11/1981 | Japan . |
| 56-199701 | 12/1981 | Japan . |
| 1530355 | 10/1978 | United Kingdom . |
| 1578960 | 11/1980 | United Kingdom . |

OTHER PUBLICATIONS

Photographic Science & Engineering, vol. 26, No. 5, Sep./Oct. 1982, pp. 239–244.

*Primary Examiner*—John D. Welsh
*Attorney, Agent, or Firm*—Peter H. Kondo

[57] ABSTRACT

An electrophotographic imaging member is described comprising a substrate, a layer comprising an amorphous hole injecting material selected from the group consisting of halogen doped selenium, gold, silver, platinum and carbon black, the halogen doped selenium consisting essentially of selenium and between about 200 parts per million and about 2,000 parts per million by weight halogen, and at least one thermal hole generating selenium alloy photoconductive layer. This electrophotographic imaging member may contain other layers such as a hole transport layer, a layer between the hole transport layer and thermal hole generating selenium alloy photoconductive layer, and a thin protective overcoating layer suitable for Carlson type imaging processes. An electrophotographic imaging process employing this electrophotographic imaging member is also described.

16 Claims, 14 Drawing Figures

ELECTROPHOTOGRAPHIC IMAGING MEMBER WITH CHARGE INJECTION LAYER

BACKGROUND OF THE INVENTION

This invention relates in general to an electrophotographic imaging system, and more specifically, to an electrophotographic imaging member containing a hole injection layer and a method of utilizing such device.

The formation and development of images on the imaging surfaces of electrophotographic imaging members by electrostatic means is well known. One of the most widely used processes being xerography described, for example, in U.S. Pat. No. 2,297,691. Numerous different types of photoreceptors can be used in the electrophotographic imaging process. Such electrophotographic imaging members may include inorganic materials, organic materials, and mixtures thereof. Electrophotographic imaging members may comprise contiguous layers in which one of the layers performs a charge generation function and the other layer forms a charge carrier transport function or may comprise a single layer which performs both the generation and transport functions. These electrophotographic imaging members may be coated with a protective overcoating to improve wear. For Carlson type electrophotographic imaging processes, the protective overcoating must allow the electrostatic charge initially deposited on the outer surface of the overcoating to form at the interface between the protective overcoating and the underlying photoconductive layer prior to repeating the next imaging cycle. Protective overcoatings may be of various organic and inorganic materials including resins, photoconductive materials and the like.

Electrophotographic imaging members based on amorphous selenium have been modified to improve panchromatic response, increase speed and to improve color copyability. These devices are typically based on alloys of selenium with tellurium. The selenium electrophotographic imaging members may be fabricated as single layer devices comprising a selenium-tellurium alloy layer which performs both charge generation and charge transport functions. The selenium electrophotographic imaging members may also contain multiple layers such as, for example, a selenium alloy transport layer and a contiguous selenium-tellurium alloy generator layer. These selenium-tellurium alloys are characterized by a tendency to thermally generate free holes in the dark. The thermal generation of free holes in the dark is a source of undesirable dark decay. In electrophotographic imaging systems employing AC or negative corotron devices for the erase step of the conventional electrophotographic imaging cycle, the electrophotographic imaging member is not uniformly discharged to residual voltage during the xerographic cycle. When an electrophotographic imaging member which thermally generates free holes in the dark is used in such systems, sensitivity of the electrophotographic imaging device is enhanced during cycling. This enhancement is observed electrically during cycling as a decrease in background voltage in the regions corresponding to the exposed portions in the preceeding cycle and is visible as a loss of low density image reproduction capability and corresponding image voltage. In electrophotographic imaging systems where the image exposure step is such that the background voltage level approaches the residual voltage level, the electrophotographic imaging member sensitivity enhancement on the next cycle occurs in an imagewise fashion. Thus, the areas of the electrophotographic imaging member discharged to background voltage level show less device sensitivity enhancement than those portions at the dark development potential or at intermediate image voltage levels. The imagewise enhancement of device sensitivity is visible as a "ghost" on cycle n+1 of the image in relation to cycle n. In order to eliminate this imagewise sensitivity enhancement, neutralization of the bulk negative space charge in the photoconductive layer resulting from the thermal generation of free holes is required. However, in electrophotographic imaging systems utilizing AC corotron or negative corotron erase stations, this bulk neutralization does not occur. The ghosting appears as a negative image on subsequent copies and, of course, is unacceptable in automatic copiers, duplicators, and printers.

SUMMARY OF THE INVENTION

It is, therefore, an object of the present invention to provide an imaging system which overcomes the above-noted disadvantages.

It is another object of this invention to provide an electrophotographic imaging member which forms images free of ghosts during cycling.

It is still another object of the present invention to provide an electrophotographic imaging member which, in conjunction with specific types of imaging systems, shows more stable imaging potentials with cycling.

The foregoing objects and others are accomplished in accordance with this invention by providing an electrophotographic imaging member comprising a substrate, a layer comprising an amorphous hole injecting material selected from the group consisting of the halogen doped selenium, gold, silver, platinum and carbon black, the halogen doped selenium consisting essentially of selenium and between about 200 parts per million and about 2,000 parts per million by weight halogen, and at least one thermal hole generating selenium alloy photoconductive layer. This electrophotographic imaging member may contain other layers such as a hole transport layer between the amorphous hole injecting material and the thermal hole generating selenium alloy photoconductive layer, an interface layer between the hole transport layer and thermal hole generating selenium alloy photoconductive layer, and a thin protective overcoating layer suitable for Carlson type imaging processes. This electrophotographic imaging member may be employed in a process involving depositing a substantially uniform positive electrostatic charge on the electrophotographic imaging member, exposing the electrophotographic imaging member to an imagewise pattern of electromagnetic radiation to which the thermal hole generating selenium photoconductive layer is responsive whereby an electrostatic latent image is formed on the electrophotographic imaging member, developing the electrostatic image with electrostatically attractable toner particles to form a toner particle deposit in image configuration, transferring the toner particle deposit to a receiving member, and subjecting the electrophotographic imaging member to AC or negative corona discharge. The process may be repeated numerous times in an automatic device.

The substrate may be opaque or substantially transparent and may comprise numerous suitable materials having the required mechanical properties. The entire substrate may comprise a composite or homogeneous material. The entire substrate may be electrically conductive or it may include an outer coating of electrically conductive material. Any suitable electrically conductive material may be employed. Typical electrically conductive materials include, for example, aluminum, titanium, nickel, chromium, brass, stainless steel, copper, gold, zinc, silver, platinum, tin, and the like. The conductive layer may vary in thickness over substantially wide ranges depending on the desired use of the electrophotoconductive member. Accordingly, the conductive layer may generally range in thickness from about 50 Angstrom units to many centimeters. Thin conductive layers are preferred when the conductive material is a precious or costly material. When a flexible electrophotographic imaging member is desired, the thickness may be between about 100 Angstrom units to about 750 Angstrom units. The substrate may be of any other conventional material including organic and inorganic materials. Typical substrate materials include insulating non-conducting materials such as various resins known for this purpose including polyesters, polycarbonates, polyamides, polyurethanes, and the like. The coated or uncoated substrate may be flexible or rigid and may have any number of configurations such as, for example, a plate, a cylindrical drum, a scroll, an endless flexible belt, and the like.

In some cases, intermediate layers between electrically conductive surface and subsequently applied layers may be desirable to improve adhesion. If such layers are utilized, they preferably have a dry thickness between about 0.1 micrometers to about 5 micrometers. Typical adhesive layers include film-forming polymers such as polyester, polyvinylbutyral, polyvinylpyrolidone, polyurethane, polymethylmethacrylate, and the like.

The amorphous hole injecting material comprises halogen doped selenium, gold, silver, platinum, or carbon black in a distinct detectable layer. Where the amorphous hole injecting material is electrically conductive, it may function as both an amorphous hole injecting material and an electrically conductive surface on the substrate. An amorphous hole injecting material consisting essentially of halogen doped selenium material is preferred because it is conveniently evaporated as the first of the vacuum deposited layers in the fabrication of the total device and because it is more compatible with the subsequently deposited vacuum deposited selenium alloys. In addition, vacuum coating hardware is more easily prepared and maintained when halogen doped selenium material is used. Moreover, the halogen doped selenium can be deposited more efficiently in conventional planetary coating systems in which subsequent selenium alloy layers may be deposited without removing substrates to be coated and without breaking the vacuum in the planetary coaters. Minor additions of arsenic might be added but are relatively undesirable and may require additional halogen to compensate for this arsenic addition. The expression "halogen materials" is intended to include fluorine, chlorine, bromine, and iodine. Chlorine is the preferred halogen because of the ease of handling and the stability of chlorine in the film (apparently due to lack of out diffusion). Preferably, the deposited halogen doped selenium layer consists essentially of selenium and about 200 parts per million to about 2,000 parts per million by weight halogen. The lower end of the range is dictated by loss of efficient hole injection. The upper end of the range arises from the practical difficulties of evaporating selenium-chlorine alloys.

The hole injection layer is positioned as a distinct detectable layer between the surface of the substrate and the thermal hole generating selenium photoconductive layer. In one embodiment of this invention, the substrate and thermal hole generating selenium photoconductive layer are contiguous to each other. In another embodiment of this invention, a transport layer is sandwiched between the injection layer and the thermal hole generating selenium photoconductive layer. Satisfactory results may be achieved with a continuous amorphous hole injecting layer having a thickness less than about 10 micrometers. The thickness of the amorphous hole injecting layer is maintained less than about 10 micrometers to minimize the total amount of halogen in the layer and coating device. Amorphous hole injecting layers having a thickness greater than about 10 micrometers lead to room temperature and high temperature dark decays which are unacceptable in precision high speed copiers, duplicators and printers. The continuous amorphous hole injecting layer may be as thin as about 0.1 micrometer. Amorphous hole injection layers having a thickness less than about 0.1 micrometer are difficult to evaporate uniformly. Preferably the amorphous hole injecting layer has a thickness between about 0.5 micrometer and about 5 micrometers. Optimum results are achieved with an amorphous hole injecting layer having a thickness between about 1 micrometer and about 2 micrometers. The amorphous hole injecting layer should be continuous and of substantially uniform thickness to ensure uniform electrophotographic properties over the entire imaging surface of the electrophotographic imaging member. The amorphous hole injecting layer may be prepared by any suitable technique. Where the amorphous hole injecting material is deposited by vacuum deposition techniques, the material to be deposited may be placed in a crucible in proximity to the substrate to be coated in a vacuum coater. The amorphous hole injecting material may then be evaporated using an appropriate time/temperature program to form the amorphous hole injecting layer on the substrate. A typical time/temperature program for halogen doped selenium involves about 14 minutes of evaporation during which the crucible temperature is increased from about 20° C. to about 350° C. with the substrate held at a temperature of about 65° C. The specific conditions employed for depositing the amorphous hole injecting materials depends on the specific materials used. For example, gold may be deposited by evaporating cut gold wire in a molybdenum crucible at a pressure of about $10^{-4}$ millimeters of mercury at room temperature and the resultant film treated with glow discharge as described, for example, in U.S. Pat. No. 4,297,424 to H. Hewitt, the entire disclosure thereof being incorporated herein by reference. Carbon black may, if desired, be applied as a dispersion in a low boiling point carrier fluid to a substrate by conventional coating techniques and the carrier fluid thereafter removed by evaporation. Other well known coating processes such as electroplating and the like may be employed where suitable.

By utilizing a hole injecting layer between the electrically conductive surface and a thermal hole generating selenium photoconductive layer, holes are efficiently injected by the amorphous hole injecting layer directly into the thermal hole generating selenium photoconductive layer or through a suitable charge transport layer, if one is employed, into the thermal hole generating selenium photoconductive layer during the negative half cycle of the AC corotron or negative corotron erase step and thereby provide uniform bulk neutralization of the bulk negative space charge in the thermal hole generating selenium photoconductive layer.

Any suitable thermal hole generating selenium alloy photoconductive layer may be employed. Typical thermal hole generating selenium photoconductive materials include selenium-tellurium alloys, arsenic triselenide, selenium-tellurium alloys doped with halogen, arsenic triselenide doped with halogen, selenium-tellurium-arsenic alloys, selenium-tellurium-arsenic alloys doped with halogen, quaternary alloys of selenium, selenium-bismuth alloys doped with iodine, arsenic-selenium alloys, arsenic-selenium-halogen alloys, selenium-germanium alloys and the like. The selenium-tellurium alloy may comprise between about 5 percent by weight and about 45 percent by weight tellurium, less than about 5 percent by weight arsenic and less than about 50 parts per million by weight halogen with the remainder being selenium.

The selenium-tellurium thermal hole generating selenium layer can be prepared in one preferred embodiment by grinding the selenium-tellurium alloy, preparing pellets from the ground material, and evaporating the pellets in crucibles in a vacuum coater using a time/-temperature crucible designed to minimize the fractionation of the alloy during evaporation. In a typical crucible evaporation program, the generating layer is formed in about 12 to about 15 minutes during which time the crucible temperature is increased from about 20° C. to about 385° C. at a pressure of between about $10^{-3}$ and about $10^{-6}$ torr. Additional details for the preparation of generating layers are disclosed, for example, in U.S. Pat. No. 4,297,424 to H. Hewitt, the entire disclosure thereof being incorporated herein by reference.

Satisfactory results may be achieved with a thermal hole generating selenium alloy photoconductive layer having a thickness between about 0.1 micrometer and about 80 micrometers, though for thicknesses in excess of 20 micrometers preferential fractionation of alloy components becomes problematical. Thermal hole generating selenium photoconductive layers having a thickness less than about 0.1 micrometer are difficult to evaporate uniformly and tend to incompletely absorb the longer wavelengths of light. The 80 micrometer thickness is based to some extent on practical thickness requirements, the specific development system to be employed, and whether a charge transport layer is used. If a charge transport layer is absent, the range of suitable thermal hole generating selenium alloy photoconductive layer thickness may be between about 15 micrometers and about 80 micrometers, preferential fractionation of alloy components being problematical for thicknesses in excess of about 20 micrometers. If a charge transport layer is utilized to form a multilayer device, the combined thickness of the thermal hole generating selenium alloy photoconductive layer and charge transport layer is preferably less than about 80 micrometers. A satisfactory range of thermal hole generating selenium alloy photoconductive layer thickness for multilayer devices may be between about 1 micrometer and about 20 micrometers. Optimum results are achieved with thermal hole generating selenium alloy photoconductive layers having a thickness of about 5 micrometers when used with a charge transport layer and about 60 micrometers when used without a charge transport layer. Generator layer thicknesses less than about 1 micrometer are subject to rapid wear and may generally be used only in conjunction with a protective organic or inorganic overcoating layer. The overcoating layer may be photoconductive or nonphotoconductive.

When the electrophotographic imaging member of this invention comprises multiple layers in which at least one layer performs a charge generation function and at least one other layer performs a charge carrier transport function, the layer performing the charge carrier transport function is a distinct and detectable layer positioned between the amorphous hole injecting layer and the thermal hole generating selenium alloy photoconductive layer.

Any suitable charge transport material may be employed. Typical charge transport materials include pure selenium, selenium-arsenic alloy, selenium-arsenic-halogen alloy, and selenium-halogen. Preferably, the charge transport layer comprises a halogen doped selenium arsenic alloy. Generally, about 10 parts by weight per million to about 200 parts by weight per million of halogen is present in a halogen doped selenium arsenic alloy transport layer. If a halogen doped selenium charge transport layer free of arsenic is utilized, the halogen content should be less than about 20 parts by weight per million. The thickness of the charge transport layer is generally between about 15 micrometers and about 75 micrometers. However, the combined thickness of the charge transport layer and thermal hole generating selenium alloy photoconductive layer is preferably less than about 80 micrometers. Inclusion of high levels of halogen in a thick halogen doped selenium charge transport layer free of arsenic leads to excessive dark decay because dark decay is substantially a function of the total chlorine in a multilayer imaging member. Imaging members containing high levels of halogen in a thick halogen doped selenium charge transport layer free of arsenic are described, for example, in U.S. Pat. No. 3,635,705 to Ciuffini, U.S. Pat. No. 3,639,120 to Snelling, and Japanese Patent Publication J5 61 42-537 to Ricoh, published June 6, 1981. The imaging members of this invention requires incorporation of high levels of chlorine in a critical, distinct, separate, thin halogen doped selenium amorphous hole injecting layer in order to achieve optimal device properties. Preferably, the charge transport layer comprises a halogen doped selenium arsenic alloy. Generally, the halogen doped selenium arsenic alloy charge transport layer comprises selenium between about 99.5 percent by weight to about 99.9 percent by weight and about 0.1 percent to about 0.5 percent by weight arsenic and between about 10 parts per million by weight to about 200 parts per million by weight of halogen, the latter halogen concetration being a nominal concentration. The expression "nominal halogen concentration" is defined as the halogen concentration in the alloy evaporated in the crucible. The expression "halogen materials" is intended to include fluorine, chlorine, bromine, and iodine. Chlorine is the preferred halogen because of the ease of handling and the stability of chlorine in the film (apparently due to lack of out diffusion).

The transport layer can be deposited by any suitable conventional technique, such as vacuum evaporation. Thus, a transport layer comprising a halogen doped selenium-arsenic alloy may be evaporated by conventional vacuum coating devices to form the desired thickness. The amount of alloy to be employed in the evaporation boats of the vacuum coater will depend on the specific coater configuration and other process variables to achieve the desired transport layer thickness. Chamber pressure during evaporation may be on the order of less than about $4\times10^{-5}$ Torr. Evaporation is normally completed in about 15 to 25 minutes with the molten alloy temperature ranging from about 250° C. to about 325° C. Other times and temperatures outside these ranges may be used as well understood by those skilled in the art. It is generally desirable that the substrate temperature be maintained in the range of from about 50° C. to about 70° C. during deposition of the transport layer. Additional details for the preparation of transport layers are disclosed, for example, in U.S. Pat. No. 4,297,424 to H. Hewitt, the entire disclosure thereof being incorporated herein by reference.

If desired, the electrophotographic imaging member of this invention may comprise other layers such as an interface layer between the transport layer and the generator layer and/or an outer protective overcoating layer on the thermal hole generating selenium alloy photoconductive layer.

The interface layer may be of any suitable material which material enhances the electrical or physical properties of the imaging member. A preferred interface layer consists essentially of selenium and a nominal halogen concentration of about 50 parts by weight per million to about 2,000 parts by weight per million halogen material. Minor additions of arsenic might be added but are relatively undesirable and may require additional halogen to compensate for this arsenic addition. The halogen concentration in the deposited interface layer will typically be somewhat less than that in the alloy evaporated in the crucible. In order to achieve optimal device properties, the actual halogen content in the final interface layer should be greater than about 20 parts by weight per million. Inclusion of high levels of halogen in thick halogen doped selenium layers free of arsenic leads to excessive dark decay because dark decay is substantially a function of the total halogen in a multilayer imaging members. Imaging members containing high levels of halogen in a thick halogen doped selenium charge transport layer free of arsenic are described, for example, in U.S. Pat. No. 3,635,705 to Ciuffini, U.S. Pat. No. 3,639,120 to Snelling, and Japanese Patent Publication No. J5 61 42-537 to Ricoh, published June 6, 1981. The expression "halogen" is intended to include fluorine, chlorine, bromine, and iodine. Chlorine is the preferred halogen because of the ease of handling and the stability of chlorine in the film (apparently due to lack of out diffusion). The interface layer material should consist essentially of selenium and an actual halogen concentration in the final interface layer of about 35 parts by weight per million to about 600 parts by weight per million halogen material. It has been found that dark decay of the electrophotographic imaging member increases with increasing interface layer thickness and with increasing halogen concentration. The improvement relating to residual cycle up when an interface layer is employed is not observed in final interface layers where the actual halogen concentrations are less than about 35 parts by weight per million. Dark decay becomes problematical at actual halogen concentrations in the final interface layer of greater than about 600 parts by weight per million.

The interface layer should be continuous and of substantially uniform thickness to ensure uniform electrophotographic properties over the entire imaging surface of the electrophotographic imaging member. If the interface layer is discontinuous, the final copy will show modulation of background and image densities dependent on photoreceptor history. The interface layer may be prepared by any suitable technique. Where the interface layer material is deposited by vacuum deposition techniques, the material to be deposited may be placed in a crucible in proximity to the substrate to be coated in a vacuum coater. The interface layer material may then be evaporated using an appropriate time/temperature program to form the interface layer on the substrate. A typical time/temperature program involves about 7 minutes evaporation during which the crucible temperature is increased from about 140° C. to about 315° C. with the substrate held at a temperature of about 65° C. The halogen doped selenium material employed in the interface layer may be efficiently deposited in conventional planetary coating systems by depositing the other selenium alloy layers prior to or subsequent to depositing the interface layer material without removing the substrate and without breaking the vacuum in the planetary coater.

The preferred thickness of the continuous interface layer depends to some extent on the halogen concentration in the interface layer. For example, satisfactory results may be achieved with a continuous interface layer having a thickness less than about 3 micrometers for nominal halogen concentrations of about 100 parts per million by weight or having a thickness less than about 1 micrometer for nominal halogen concentrations of about 300 parts per million by weight. Generally, depending on the thickness of the interface layer, the interface layer may have a nominal halogen concentration of between about 50 parts per million by weight and about 2,000 parts per million by weight. It has been found that dark decay of the electrophotographic imaging member increases with increasing interface layer thickness and with increasing nominal halogen concentration. Optimum results are achieved with a continuous interface layer having a thickness between about 1 micrometer and about 3 micrometers at a nominal chlorine concentration between about 100 parts per million by weight and about 300 parts per million by weight.

By incorporation of a continuous halogen doped selenium interface layer between the transport layer and a generating layer, residual cycle-up due to cycle rate, thermal cycling at elevated temperatures and undesirable interactions with lamps and corotrons around the electrophotographic imaging member is markedly minimized in electrophotographic copiers, duplicators and printers.

When, a protective overcoating is employed, it must allow the electrophotographic imaging member to be utilized in the conventional Carlson type electrophotographic imaging process in which the imaging member is normally uniformly charged once and then exposed to activating illumination in image configuration to form an electrostatic latent image. Thick insulating overcoatings do not allow the use of the conventional Carlson type electrophotographic imaging process, require multiple charging steps, and operate in an entirely different manner than the imaging member of this invention. Thus, the imaging member of this invention is entirely free of thick insulating overcoatings that prevent the use of the imaging member in the conventional Carlson type electrophotographic imaging process. Any suitable conventional electrostatic charge permeable continuous protective overcoating may be used which allows the positive electrostatic charge initially deposited on the outer surface of the overcoating to form at the interface between the electrostatic charge permeable continuous protective overcoating and the thermal hole generating selenium alloy photoconductive layer prior to repeating the next imaging cycle. Typical electrostatic charge permeable continuous protective overcoatings include, for example, thin polysiloxane overcoatings from ammonia cured cross-linkable siloxanol-colloidal silica hybrid material having at least one silicon bonded hydroxyl group per every three —SiO— units as described in U.S. Pat. No. 4,439,509 to R. Schank, finely divided metal oxide particles dispersed in a resin as described in U.S. Pat. No. 4,426,435 to K. Oka, thin photoconductive overcoatings and the like. The entire disclosures of these two patents are incorporated herein in their entirety. The thickness of the overcoatings generally ranges from about 0.5 micrometer to about 20 micrometers depending upon the specific electrostatic charge permeable continuous protective overcoating material employed.

BRIEF DESCRIPTION OF THE DRAWINGS

A more complete understanding of the process and device of the present invention can be achieved by reference to the accompanying drawings wherein.

Figure 1:
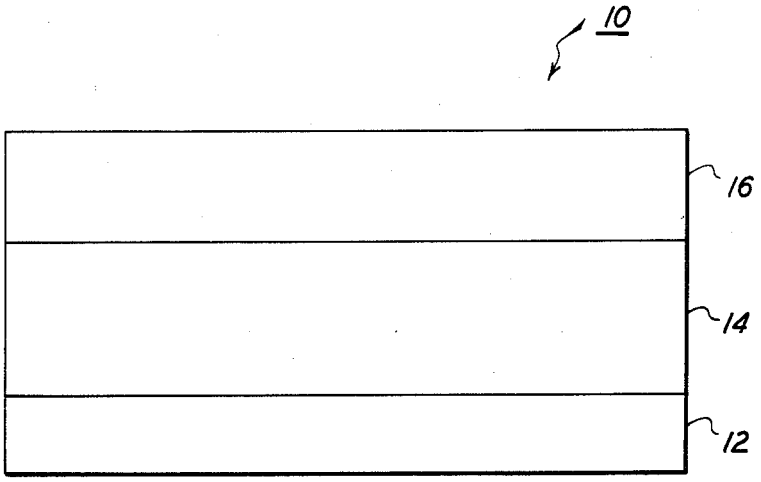
FIG. 1 graphically illustrates a typical prior art multilayered photoreceptor comprising a thermal hole generating layer and a transport layer supported on a conductive substrate.

Illustrated in FIG. 1 is an electrophotographic imaging member 10 of the prior art comprising a substrate 12, a transport layer 14 comprising a halogen doped selenium-arsenic alloy layer and a generating layer 16 comprising an alloy of selenium-tellurium.

The substrate 12 may comprise any suitable material having the required mechanical properties. Typical substrates include aluminum, nickel and the like. The thickness of the substrate layer is dependent upon many factors including economic considerations, design of the device in which the electrophotographic imaging is to be used, and the like. Thus, the substrate may be of substantial thickness, for example, up to 200 mils, or of minimum thickness such as about 5 mils. Generally, the thickness of the substrate ranges from about 5 mils to about 200 mils. The substrate may be flexible or rigid and may have different configurations as described above.

The transport layer 14 comprises a halogen doped selenium arsenic alloy, however, an undoped alloy may also be used. The percent of selenium present in the selenium arsenic alloy may range from about 99.5 percent to about 99.9 percent by weight and the percentage of arsenic present may range from about 0.1 percent by weight to about 0.5 percent by weight. The amount of halogen such as chlorine, fluorine, iodine or bromine present in the doped alloy layer range from about 10 parts by weight per million to about 200 parts by weight per million with the preferred range being from about 20 parts by weight per million to about 100 parts by weight per million. The preferred halogen is chlorine. This layer generally ranges in thickness from about 15 micrometers to about 75 micrometers and preferably from about 25 micrometers to about 50 micrometers because of constraints imposed by the xerographic development system, constraints imposed by carrier transport limitations and for economic reasons.

The generating layer 16 comprises a thermal hole generating selenium alloy photoconductive material. Typical thermal hole generating selenium photoconductive materials include selenium-tellurium alloys, arsenic triselenide, selenium-tellurium alloys doped with halogen, arsenic triselenide doped with halogen, selenium-tellurium-arsenic alloys, selenium-tellurium-arsenic alloys doped with halogen, quaternary alloys of selenium, selenium-bismuth alloys doped with iodine, arsenic-selenium alloys, arsenic-selenium-halogen alloys, selenium-germanium alloys and the like. An alloy of selenium and tellurium is preferred because the physical properties such the coefficient of expansion are more closely matched with the selenium materials in the other layers. Generally, the selenium-tellurium alloy may comprise from about 55 percent by weight to about 95 percent by weight selenium and from about 5 percent by weight to about 45 percent by weight tellurium based on the total weight of the alloy. The thickness of the generator layer is generally less than about one micrometer when the tellurium content is about 40 percent. The selenium-tellurium alloy may also comprise other components such as less than about 5 percent by weight arsenic to minimize crystallization of the selenium and less than about 1000 parts by weight per million halogen.

Figure 2:
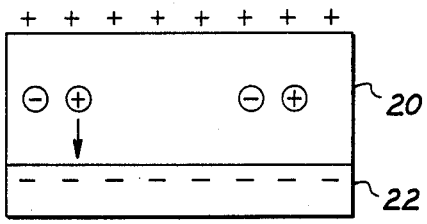
FIGS. 2 through 8 graphically illustrate the imaging mechanism for a typical prior art single layered photoreceptor comprising a thermal hole generating layer supported on a conductive substrate when subjected to negative or AC corotron erase.
Figure 3:
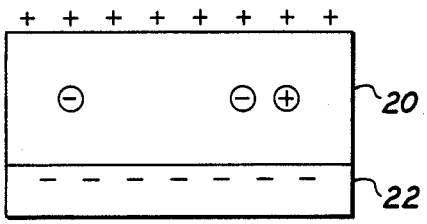
Figure 4:
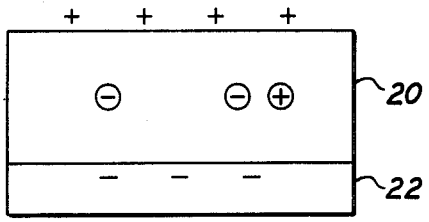
Figure 5:
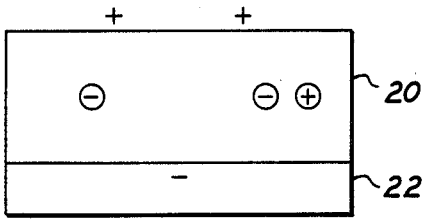
Figure 6:
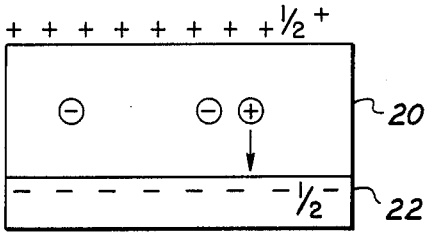
Figure 7:
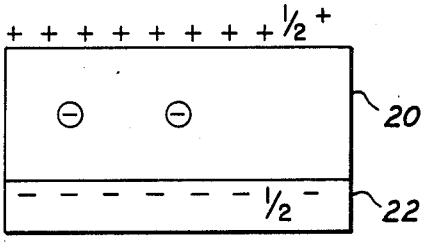
Figure 8:
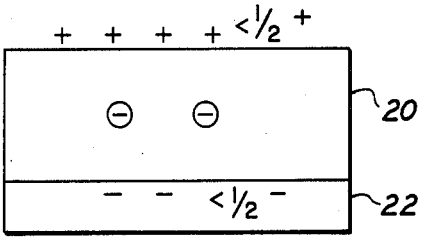

The appearance of negative ghosting is believed to be driven by the development of imagewise device sensitivity enhancement. The mechanism of device sensitivity enhancement is depicted in FIGS. 2–8. In FIG. 2, a photoconductive layer 20 on supporting substrate 22 is uniformly charged with a positive charge. An equal and opposite charge is formed in the conductive layer 22 adjacent the photoconductive layer 20. Thermal bulk generation gives rise to bulk negative space charge development during cycling of the photoreceptor. In machine configurations utilizing AC corotron or negative erase, the space charge is not neutralized cycle by cycle and the field in the photogeneration region increases as the essentially constant voltage charge corotron continually increments the surface charge to compensate for the growing bulk negative space charge. Since the photogeneration process is field dependent, device sensitivity grows cycle by cycle as illustrated in FIGS. 2–8, and the background voltage falls for a fixed exposure level. Thus, by utilizing an AC or negative discharge (erase) corotron, uniform bulk charge neutralization (such as would be produced by an erase lamp) does not occur. However, exposure levels are such that in regions of high exposure illumination corresponding to background regions on the copy, a measure of bulk negative space charge neutralization can occur. The outcome of this process is that by comparison with the corresponding background regions, regions at $V_{DDP}$ on one cycle represent regions of higher device sensitivity on the next cycle, i.e. imagewise sensitivity enhancement occurs.

Figure 9:
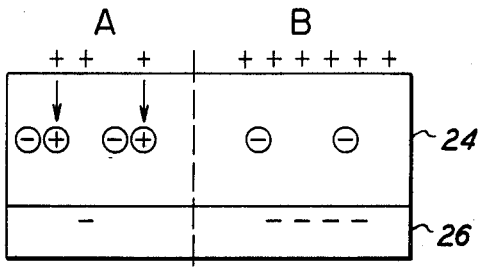
FIGS. 9 through 11 graphically illustrate the imaging mechanism for a typical prior art single layered photoreceptor comprising a thermal hole generating layer supported on a conductive substrate when subjected to negative or AC corotron erase.
Figure 10:
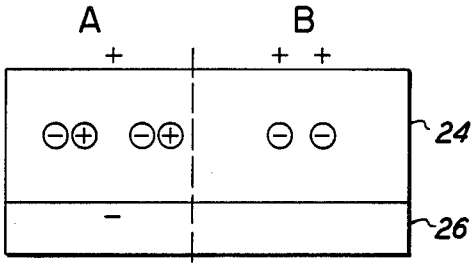
Figure 11:
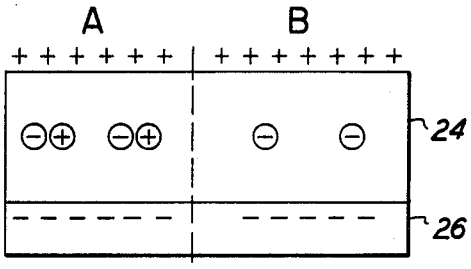

Referring now to FIG. 9, a photoconductive imaging member comprising a photoconductive layer 24 supported on a conductive substrate 26 is shown in which the background or exposed region is designated by A and the unexposed $V_{DDP}$ region is designated by B. The "naked" negative centers within the photoconductive layer 24 are neutralized during photo discharge. The naked negative centers within the photoconductive layer 24 in region B are not neutralized. Upon AC discharge, shown in FIG. 10 followed by recharge in the next imaging cycle as shown in FIG. 11, the region A corresponding to the background or exposed region in the cycle illustrated in FIG. 9, exhibits a lower sensitivity as shown in FIG. 11 whereas the region B corresponding to the unexposed region shown in FIG. 9 exhibits a higher sensitivity (higher field in the photogeneration region) as illustrated in FIG. 11. Since enhancement of sensitivity occurs in regions formerly at $V_{DDP}$ on the previous imaging cycle, a negative rather than positive ghost results on the next image cycle.

Figure 12:
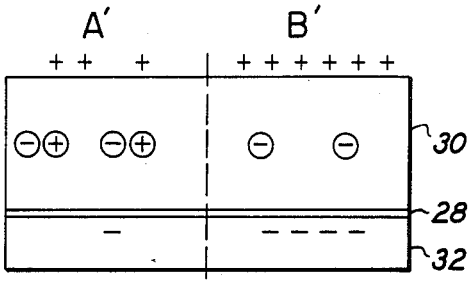
FIGS. 12 through 14 graphically illustrate the imaging mechanism for a layered photoreceptor of this invention comprising a thermal hole generating layer and a hole injecting layer supported on a conductive substrate when subjected to negative or AC corotron erase.
Figure 13:
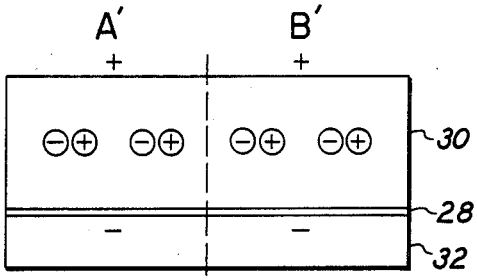
Figure 14:
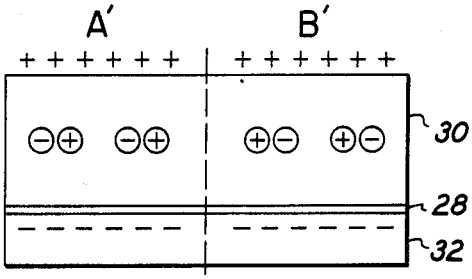

Referring to FIG. 12, an electrophotographic imaging member is depicted in which an amorphous hole injecting layer 28 is sandwiched between a photoconductive layer 30 and a supporting conductive layer 32. The principal difference between electrophotographic imaging member of FIG. 12 and that of FIG. 9 is the presence of the amorphous hole injecting layer 28 shown in FIG. 12. It is apparent in comparing FIG. 12 to FIG. 9, the effects following uniform charge and imagewise exposure are the same. However, as the electrophotographic imaging member having the amorphous hole injecting layer shown in FIG. 12 is subjected to AC discharge, uniform hole injection from the substrate occurs on negative half cycles as depicted in FIG. 13. Bulk negative space charge neutralization takes place at low fields under conditions of efficient injection thereby resulting in equal sensitivity in regions A' and B' following the next charge cycle as illustrated in FIG. 14. This eliminates the imagewise sensitivity enhancement shown in FIG. 11 which gives rise to ghosting.

Any suitable development technique may be utilized to develop the electrostatic latent image on the electrophotographic imaging member of this invention. Well known electrophotographic development techniques include, for example, cascade development, magnetic brush development, liquid development, powder cloud development and the like. The deposited toner image may be transferred to a receiving member by any suitable conventional transfer technique and affixed to the receiving member by any suitable well known fusing technique. While it is preferable to develop an electrostatic latent image with toner particles, the electrostatic latent image may be employed in a host of other ways such as, for example, "reading" the electrostatic latent image with an electrostatic scanning system. Cleaning of the photoreceptor to remove any residual toner particles remaining after transfer may be effected by any suitable conventional cleaning technique such as brush cleaning, blade cleaning, web cleaning and the like.

After cleaning, the photoreceptor is subjected to an erase treatment. Erase may be effected by conventional erase techniques such as AC corona discharge or negative corona discharge. Although other conventional erase techniques such as illumination from a light source, contact with a grounded conductive brush, or combinations thereof may be employed. The photoreceptor of this invention is particularly suitable for eliminating negative ghosting problems associated with AC corona or negative corona erase systems.

The invention will now be described in detail with respect to specific preferred embodiments thereof, it being understood that these examples are intended to be illustrative only and that the invention is not intended to be limited to the materials, conditions, process parameters and the like recited herein. All parts and percentages are by weight unless otherwise indicated.

EXAMPLE I

A control electrophotographic imaging member was prepared by evaporating at a temperature of about 300° C. from a stainless steel crucible at a pressure of about $2\times10^{-5}$ torr onto an aluminum cylinder having a diameter of about 12 centimeters maintained at a temperature of about 70° C. a chlorine doped selenium-arsenic alloy to form a chlorine doped selenium-arsenic charge transport layer having a thickness of about 35 micrometers and containing about 0.5 percent by weight arsenic, about 99.5 percent by weight selenium and about 20 parts per million by weight chlorine. This coated substrate was then coated by evaporating at a temperature of about 350° C. from a stainless steel crucible at a pressure of about $2\times10^{-5}$ torr a chlorine doped selenium-tellurium alloy to form a thermal hole generating selenium alloy photoconductive generator layer having a thickness of about 20 micrometers and containing about 10 percent by weight tellurium, 90 percent by weight selenium and about 25 parts per million by weight chlorine. This electrophotographic imaging member was then tested for negative ghosting characteristics, i.e. images that appear in regions of low image density or high background. It has been found that testing for ghosting characteristics may be conducted by simply charging an electrophotographic imaging member in the dark during cycling to a negative surface potential by means of a negative charging scorotron and noting the negative charge acceptance. High negative charge acceptance during cycling under the negative charging scorotron correlates with the appearance of negative ghosting and also correlates with rear interface (interface between conductive layer and transport layer) hole injection efficiency. The surface speed of the electrophotographic imaging member was 15.8 cm/sec. The voltage on the negative scorotron control grid was maintained at such a voltage that the surface potential on the imaging member exiting the scorotron was −900 volts. The surface potential measured by an electrostatic voltmeter approximately 1 second after charging was −350 volts. Such a surface potential is consistent with the inefficient hole injection characteristics of the substrate-transport layer interface. This photoreceptor was then cycled in an electrophotographic processor in which the surface speed of the electrophotographic imaging member was 25.4 cm/sec. The document length was 11 inches, the interdocument gap on the electrophotographic imaging member was 21.1 centimeters, and the precession of the image on the drum (as measured by the separation between the image and its negative ghost) was about 11 centimeters. The electrophotographic imaging member was first charged in the dark to a positive potential of about 900 volts, exposed to a test pattern that included high density, mid density and low density images configured such that regions of different density overlapped on successive cycles using an apertured fluorescent lamp to form an electrostatic latent image, and then developed with a liquid developer to form a visible toner image corresponding to the electrostatic latent image. The toner image was transferred to a sheet of paper with the aid of a transfer corotron and residual liquid developer was cleaned from the surface of the photoreceptor by means of a cleaning blade and cleaning roller. The photoreceptor was then processed through an erase station in which the surface of the photoreceptor was subjected to AC corotron discharge. The voltage supply to the AC corotron was maintained at about 5,000 volts AC. An imagewise ghost of lower density corresponding to regions of high density on the previous copy cycle were observed in mid density and low density regions in the second and subsequent copies.

EXAMPLE II

The procedure of Example I was repeated except that an amorphous hole injecting material was deposited onto the aluminum substrate prior to deposition of the transport layer. The amorphous hole injecting material was applied by evaporating a chlorine doped amorphous selenium material containing 3,000 parts by weight per million of chlorine (concentration prior to evaporation) at a temperature of about 350° C. from a stainless steel crucible at a pressure of about $2\times10^{-5}$ torr onto an aluminum substrate maintained at a temperature of about 70° C. to form an amorphous hole injecting layer having a thickness of about 1 micrometer and having a chlorine concentration of about 500 parts by weight per million. This photoreceptor containing the amorphous hole injecting layer was then subjected to imaging cycles as described in Example I. The negative charge acceptance was only −30 volts consistent with efficient substrate hole injection and no negative ghosting was observed on any of the copies.

EXAMPLE III

The procedure of Example II was repeated except that the amorphous hole injecting material was applied by evaporating a chlorine doped amorphous selenium material containing 2,750 parts by weight per million of chlorine (concentration prior to evaporation) at a temperature of about 350° C. from a stainless steel crucible at a pressure of about $2\times10^{-5}$ torr onto an aluminum substrate maintained at a temperature of about 70° C. to form an amorphous hole injecting layer having a thickness of about 1 micrometer and having a chlorine concentration of about 800 parts by weight per million. This photoreceptor containing the amorphous hole injecting layer was then subjected to imaging cycles as described in Example I. The negative charge acceptance after the 1st cycle was −8 volts and no negative ghosting was observed on any of the copies.

EXAMPLE IV

A control electrophotographic imaging member was prepared by evaporating at a temperature of about 350° C. from a stainless steel crucible at a pressure of about $2\times10^{-5}$ torr onto an aluminum cylinder having a diameter of about 12 centimeters maintained at a temperature of about 70° C. a selenium-tellurium alloy to form a thermal hole generating selenium-tellurium alloy layer having a thickness of about 55 micrometers and containing about 10 percent by weight tellurium and 90 percent by weight selenium. This electrophotographic imaging member was then tested for negative ghosting characteristics, i.e. images that appear in regions of low image density or high background. It has been found that testing for ghosting characteristics may be conducted by simply charging an electrophotographic imaging member in the dark during cycling to a negative surface potential by means of a negative charging scorotron and noting the negative charge acceptance. High negative charge acceptance during cycling under the negative charging scorotron correlates with the appearance of negative ghosting and also correlates with rear interface (interface between conductive layer and selenium-tellurium alloy layer) hole injection efficiency. The surface speed of the electrophotographic imaging member was 15.8 cm/sec. The voltage on the negative scorotron control grid was maintained at such a voltage that the surface potential on the imaging member exiting the scorotron was −900 volts. The surface potential measured by an electrostatic voltmeter approximately 1 second after charging was −250 volts. Such a surface potential is consistent with the inefficient hole injection characteristics of the substrate-transport layer interface. This photoreceptor was then cycled in an electrophotographic processor in which the surface speed of the electrophotographic imaging member was 25.4 cm/sec. The document length was 11 inches, the interdocument gap on the electrophotographic imaging member was 21.1 centimeters, and the precession of the image on the drum (as measured by the separation between the image and its negative ghost) was about 11 centimeters. The electrophotographic imaging member was first charged in the dark to a positive potential of about 900 volts, exposed to a test pattern that included high density, mid density and low density images configured such that regions of different density overlapped on successive cycles using an apertured fluorescent lamp to form an electrostatic latent image, and then developed with a liquid developer to form a visible toner image corresponding to the electrostatic latent image. The toner image was transferred to a sheet of paper with the aid of a transfer corotron and residual toner particles were cleaned from the surface of the photoreceptor by means of a cleaning blade and cleaning roller. The photoreceptor was then processed through an erase station in which the surface of the photoreceptor was subjected to AC corotron discharge. The voltage supply to the AC corotron was maintained at approximately 5,000 volts AC. An imagewise ghost of lower density corresponding to regions of high density on the previous copy cycle were observed in mid density and low density regions in the fifth and subsequent copies.

EXAMPLE V

The procedure of Example IV was repeated except that an amorphous hole injecting material was deposited onto the aluminum substrate prior to deposition of the selenium-tellurium layer. The amorphous hole injecting material was applied by evaporating a chlorine doped amorphous selenium material containing 3,000 parts by weight per million of chlorine (concentration prior to evaportation) at a temperature of about 350° C. from a stainless steel crucible at a pressure of about $2\times10^{-5}$ torr onto an aluminum substrate maintained at a temperature of about 70° C. to form an amorphous hole injecting layer having a thickness of about 1 micrometer and having a chlorine concentration of about 500 parts by weight per million. This photoreceptor containing the amorphous hole injecting layer was then subjected to imaging cycles as described in Example IV. The negative charge acceptance after the 1st cycle was only −40 volts consistent with efficient substrate hole injection and no negative ghosting was observed on any of the copies.

EXAMPLE VI

The procedure of Example I was repeated except that an amorphous hole injecting material was deposited onto the aluminum substrate prior to deposition of the transport layer and a continuous interface layer was deposited onto the transport layer prior to deposition of the generator layer. The amorphous hole injecting material was applied by evaporating a chlorine doped amorphous selenium material containing 3,000 parts by weight per million of chlorine (concentration prior to evaporation) at a temperature of about 350° C. from a stainless steel crucible at a pressure of about $2\times10^{-5}$ torr onto an aluminum substrate maintained at a temperature of about 70° C. to form an amorphous hole injecting layer having a thickness of about 1 micrometer and having a chlorine concentration of about 500 parts by weight per million. A continuous interface layer was applied by evaporating a chlorine doped amorphous selenium material containing 2,000 parts by weight per million of chlorine (concentration prior to evaporation) at a temperature of about 315° C. from a stainless steel crucible at a pressure of about $2\times10^{-5}$ torr onto a transport layer having the composition and thickness described in Example I and maintained at a temperature of about 70° C. to form a continuous interface layer having a thickness of about 1 micrometer and a chlorine concentration of about 400 parts per million by weight. A generator layer having the composition and thickness described in Example I was applied using the same procedures as in Example I. The negative charge acceptance was only −3 volts and no negative ghosting was observed on any of the copies.

Although the invention has been described with reference to specific preferred embodiments, it is not intended to be limited thereto, rather those skilled in the art will recognize that variations and modifications may be made therein which are within the spirit of the invention and within the scope of the claims.

We claim:

1. An electrophotographic imaging member comprising a substrate, a distinct continuous layer of an amorphous hole injecting material having a thickness of less than about 10 micrometers, said amorphous hole injecting material consisting essentially of selenium and between about 200 parts per million and about 2,000 parts per million by weight halogen, and at least one thermal hole generating selenium alloy photoconductive layer, said electrophotographic imaging member being free of any insulating charge retaining protective overcoating.

2. An electrophotographic imaging member according to claim 1 including at least one distinct hole transport layer between said hole injecting material and said thermal hole generating selenium alloy photoconductive layer, said hole transport layer being in operative contact with said hole injecting material.

3. An electrophotographic imaging member according to claim 2 wherein said hole transport layer comprises a halogen doped selenium arsenic alloy comprising about 99.5 percent to about 99.9 percent by weight selenium, about 0.5 percent to about 0.1 percent by weight arsenic and about 10 parts per million to about 200 parts per million by weight halogen.

4. An electrophotographic imaging member according to claim 1 wherein said thermal hole generating selenium alloy photoconductive layer comprises an alloy of selenium-tellurium, said thermal hole generating selenium alloy photoconductive layer comprising a selenium-tellurium alloy comprising from about 55 percent by weight to about 95 percent by weight selenium and from about 5 percent by weight to about 45 percent by weight tellurium based on the total weight of said selenium-tellurium alloy.

5. An electrophotographic imaging member according to claim 4 wherein said selenium-tellurium alloy comprises up to about 5 percent by weight arsenic based on the total weight of said alloy.

6. An electrophotographic imaging member according to claim 4 wherein said selenium-tellurium alloy comprises up to about 1,000 parts per million by weight halogen.

7. An electrophotographic imaging member according to claim 1 wherein said hole injecting material comprises a distinct continuous layer having a thickness between about 0.5 micrometer and about 5 micrometers.

8. An electrophotographic imaging member according to claim 1 wherein said halogen is chlorine.

9. An electrophotographic imaging member according to claim 1 including a plurality of layers on said amorphous hole injecting material including an electrostatic charge permeable continuous protective overcoating on said thermal hole generating selenium alloy photoconductive layer, said electrostatic charge permeable continuous protective overcoating being capable of allowing a uniformly deposited positive electrostatic charge to form at the interface between said electrostatic charge permeable continuous protective overcoating and said thermal hole generating selenium alloy photoconductive layer.

10. An electrophotographic imaging member according to claim 1 including an interface layer between said thermal hole generating selenium alloy photoconductive layer and said hole transport layer, said interface layer consisting essentially of selenium and between about 35 parts per million and about 600 parts per million by weight halogen.

11. An electrophotographic imaging member comprising a substrate, a layer of an amorphous hole injecting material consisting essentially of selenium and between about 200 parts per million and about 2,000 parts per million by weight halogen, at least one distinct hole transport layer comprising a halogen doped selenium material free of arsenic comprising less than about 20 parts per million by weight halogen, and at least one thermal hole generating selenium alloy photoconductive layer in operative contact with said hole transport layer.

12. An electrophotographic imaging process comprising providing an electrophotographic imaging member comprising a substrate, a layer of an amorphous hole injecting material consisting essentially of selenium and between about 200 parts per million and about 2,000 parts per million by weight halogen and at least one thermal hole generating selenium alloy photoconductive layer, depositing a substantially uniform positive electrostatic charge on said electrophotographic imaging member, exposing said electrophotographic imaging member to an imagewise pattern of electromagnetic radiation to which said thermal hole generating selenium alloy photoconductive layer is responsive whereby an electrostatic latent image is formed on said electrophotographic imaging member, developing said electrostatic latent image with electrostatically attractable toner particles to form a toner particle deposit in image configuration, transferring said toner particle deposit to a receiving member, and subjecting said electrophotographic imaging member to AC or negative corona discharge.

13. An electrphotographic image process according to claim 12 wherein said electrophotographic imaging member comprises a distinct hole transport layer between said hole injecting material and said thermal hole generating selenium alloy photoconductive layer and in operative contact with said hole injecting material, said hole transport material comprising a halogen doped selenium arsenic alloy comprising about 99.5 percent to about 99.9 percent by weight selenium, about 0.5 percent to about 0.1 percent by weight arsenic and about 10 parts per million to about 200 parts per million by weight halogen.

14. An electrophotographic imaging process according to claim 13, wherein said selenium alloy photoconductive layer comprises a selenium-tellurium alloy comprising from about 55 percent by weight to about 95 percent by weight selenium and from about 5 percent by weight to about 45 percent by weight tellurium based on the total weight of said selenium-tellurium alloy.

15. An electrophotographic imaging process according to claim 13 wherein said imaging process is repeated at least once.

16. An electrophotographic imaging process according to claim 15 wherein said thermal hole generating selenium alloy photoconductive layer is overcoated with an electrostatic charge permeable continuous protective overcoating on said thermal hole generating selenium alloy photoconductive layer which allows said uniform positive electrostatic charge to form at the interface between said electrostatic charge permeable continuous protective overcoating and said thermal hole generating selenium alloy photoconductive layer prior to repeating said image process.

* * * * *